US008628365B2

(12) United States Patent
Burdick et al.

(10) Patent No.: US 8,628,365 B2
(45) Date of Patent: Jan. 14, 2014

(54) SWIM FIN

(76) Inventors: Marlene Burdick, Norwalk, CA (US); Vesta Mashburn, Hermosa Beach, CA (US)

( * ) Notice: Subject to any disclaimer, the term of this patent is extended or adjusted under 35 U.S.C. 154(b) by 7 days.

(21) Appl. No.: 13/506,908

(22) Filed: May 24, 2012

(65) Prior Publication Data

US 2013/0316604 A1 Nov. 28, 2013

(51) Int. Cl.
*A63B 31/08* (2006.01)

(52) U.S. Cl.
USPC ..... 441/64

(58) Field of Classification Search
USPC ..... 441/64
See application file for complete search history.

(56) References Cited

U.S. PATENT DOCUMENTS

| | | | | |
|---|---|---|---|---|
| 915,457 | A | | 3/1909 | Marriotte |
| 1,674,801 | A | | 6/1928 | Schwalge |
| 2,099,973 | A | | 11/1937 | Corlieu |
| 2,343,468 | A | | 3/1944 | Messinger |
| 3,239,857 | A | | 3/1966 | Gwynne |
| 4,017,925 | A | | 4/1977 | Shamlian |
| 4,907,519 | A | | 3/1990 | Gil |
| 4,952,183 | A | * | 8/1990 | Gil ..... 441/64 |
| 5,183,424 | A | | 2/1993 | Field |
| 5,358,439 | A | | 10/1994 | Paolo |
| D355,012 | S | | 1/1995 | Robertson |
| 5,597,336 | A | | 1/1997 | Evans |
| D472,291 | S | | 3/2003 | McLure et al. |
| 6,884,136 | B1 | | 4/2005 | McCarthy |
| 7,048,601 | B2 | | 5/2006 | Sclafani |
| 7,361,070 | B2 | | 4/2008 | Bolstor |
| 2005/0186866 | A1 | | 8/2005 | McCarthy |
| 2007/0032148 | A1 | * | 2/2007 | McCarthy ..... 441/64 |
| 2009/0137166 | A1 | * | 5/2009 | Melius ..... 441/64 |
| 2011/0312231 | A1 | | 12/2011 | Montemurro |

* cited by examiner

*Primary Examiner* — Stephen Avila
(74) *Attorney, Agent, or Firm* — William W. Haefliger

(57) ABSTRACT

A swim fin having, in combination, a blade including an inner thin board, and upper and lower Neoprene sheet or sheets covering upper and lower sides of the board, the upper Neoprene sheet defining a foot entrance, a forward foot retention strap or straps carried by the blade to extend proximate said entrance and over the foot, a rearward ankle/heel retainer carried by the blade to extend above the rearwardmost portion of the blade, the forward retention strap and said rearward retainer both being flexible, and primary seam binding extending at the periphery of said board, connecting the Neoprene sheet or sheets to the board and also anchoring the forward strap and the rearward retainer to the board.

16 Claims, 4 Drawing Sheets

SWIM FIN

BACKGROUND OF THE INVENTION

This invention relates generally to significant improvements in swim fins worn on user's feet; and more particularly concerns a swim fin having unique, compact, lightweight, non-metallic construction affording many improvements in use, and safety, as will appear.

There is need for improvements in swim fins, considering these extensive uses in swimming as in pools, lakes and the ocean. In particular, there is need for the extensive improvements as embodied in the swim fin disclosed herein.

SUMMARY OF THE INVENTION

It is a major object of the invention to provide an extensively improved swim fin, characterized basically as including:

a) a blade including an inner thin base board, and upper and lower Neoprene sheet or sheets covering upper and lower sides of the board, b) the upper Neoprene sheet defining a foot entrance, c) a forward foot retention strap or straps carried by the blade to extend proximate that entrance and over the foot, d) a rearward ankle-heel retainer carried by the blade to extend above the rearwardmost portion of the blade, e) the forward retention strap and the rearward retainer both being flexible, f) and primary seam binding extending at the periphery of the base board, for connecting the Neoprene sheet or sheets to the board, and also anchoring the forward strap and the rearward retainer to the board.

Further objects include provision of primary and secondary seam bindings operating to ensure protection of the connections of the Neoprene upper and lower covers to the blade board, at its periphery, and of the forward strap ends and of the rearward retainer to the foot board periphery, as will appear.

Additional objects include:

i) provision of overall construction to allow a pair of fins to be worn on the left or right foot without preference, making no distinction between either of the fins, ii) provision of foot retaining elements to enable self-tensioning as the foot moves to ensure maximum comfort with no blistering or chafing to the foot and toes, iii) provision of a drain hole opening to ensure that water flows through the toe area so as to prevent drag, during use, iv) provision of a small dart seamed in the center of the lower heel which keeps the heel in place, v) provision of a foot enclosure that is tightened securely when it encases the ankle and lower leg to immobilize the ankle against inversion or eversion while permitting plantar-flexion and dorsa-flexion, vi) provision of a foot enclosure that adapts to any size foot or ankle that has been distorted from birth, injuries or surgeries, that has caused a difference in the user's left and right foot sizes, vii) provision of foot enclosure affording enhanced user's ankle stability as with ankle injuries such as strains, breaks, fractures and ligament injuries and it also compensates for ankle weakness, such as tendonitis, arthritis and osteoporosis, while also affording stability to the ankle to help prevent ankle joint twisting (anterior subluxation) that may generate unwanted force on the user's feet, ankles, knees and hips.

viii) provision of a formed arch support strap sewn onto the side instep area, drawn across the top of the foot and threaded into a plastic rectangular loop on the opposite side of the foot, and pulled back and secured to the top of the foot with Velcro hook connections sewn in place on the strap, with heel and ankle resultantly secured firmly on the polypropylene and Neoprene fin base.

Another object is to provide an easily deployed structure during foot entrance, with an open position wherein the forward strap and rearward retainer have an open and substantially flattened configuration in which flexible and mutually attachable flaps defined by the rearward retainer extend in opposite lateral directions, and a shallow, warped, cup-shaped heel entrance defined by the rearward retainer is positioned in semi-flattened condition between such flaps, the base and flaps defining an overall T-shape, flexibility of the straps, flaps and of the cover at the foot entrance allowing ready flexing thereof to ease accommodation fit to and comfort of foot entrance to the apparatus, and heel positioning, prior to strap and flap attachment tightening, with comfort.

These and other objects and advantages of the invention, as well as the details of an illustrative embodiment, will be more fully understood from the following specification and drawings, in which:

DRAWING DESCRIPTION

DETAILED DESCRIPTION

A bend resistant polypropylene fin insert 1 is a base plate inserted between two co-terminous flexible Neoprene fin base plate coverings or sheets 5 extending in face to face relation with upper and lower sides of insert 1. The composite is then sewn together at overlapping upper and lower deflected edge portions 5*a*, by stitching 5*b*, along the peripheral edge of the fin base plate, and reinforced with C-shaped synthetic elastomer bindings 6 and 6*a*.

Figure 2:
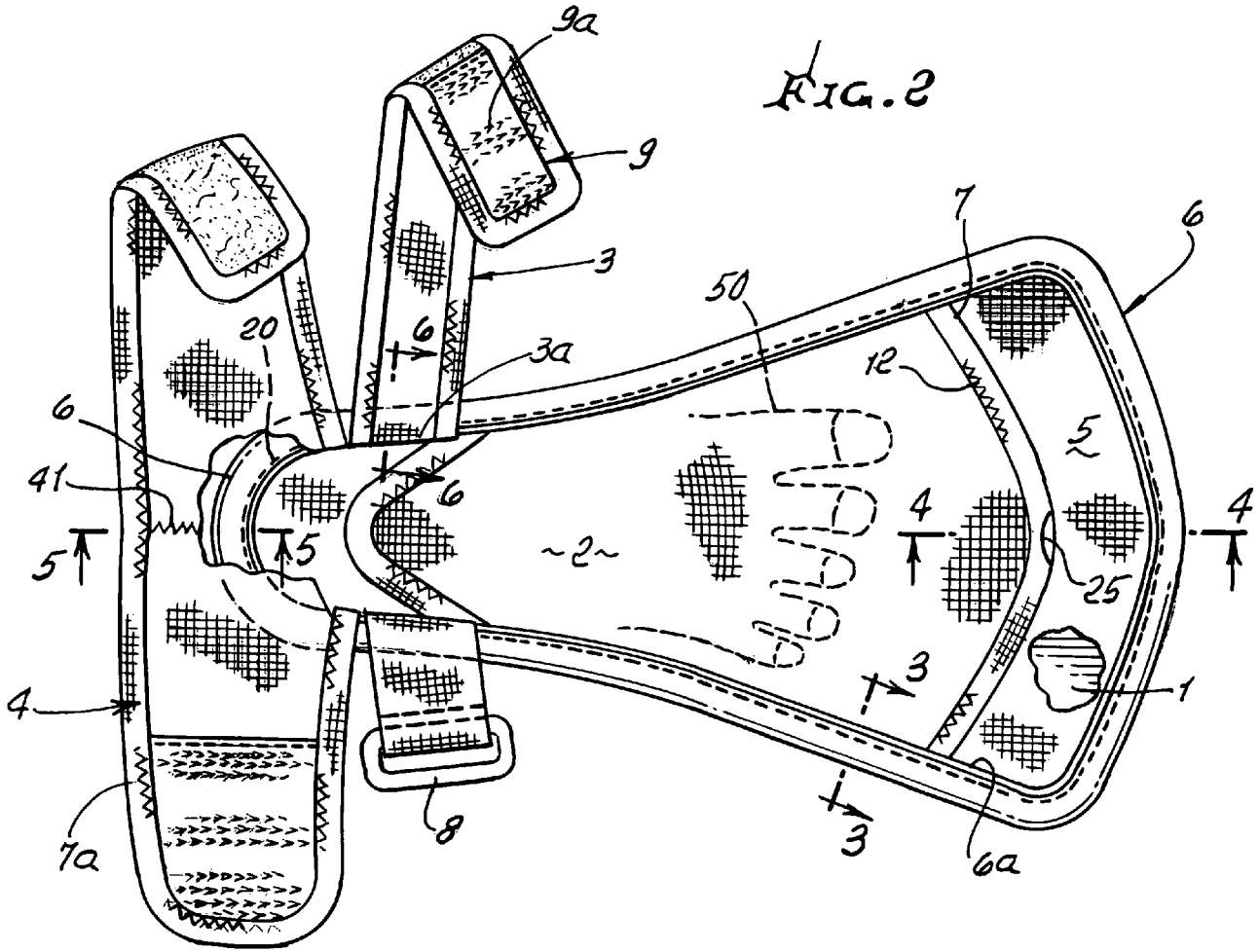
FIG. 2 is a top plan view of the FIG. 1 fin, with retainers deployed.
Figure 4:
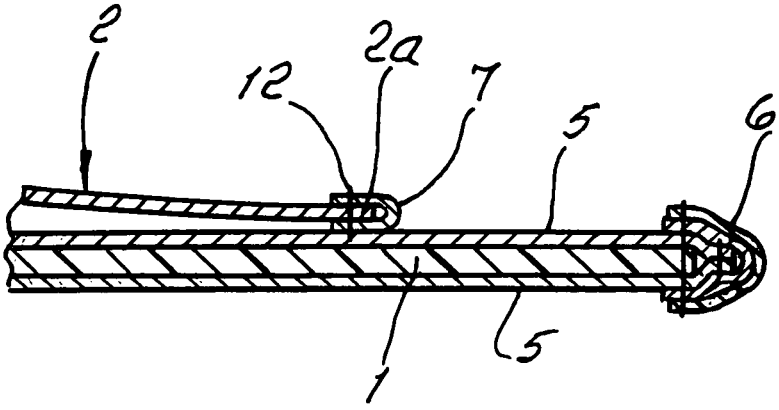
FIG. 4 is an enlarged section taken on lines 4-4 of FIG. 2.

As seen in FIG. 4, the Neoprene foot covering enclosure 2 under which the foot slides is located upon the top Neoprene fin base cover 5. It is sewn at 12 at and along its edges 2*a*, and reinforced in position with synthetic elastomer binding 7, at the periphery of the foot enclosure 2. See FIG. 4. FIG. 2 shows the position at 50 of a foot, in broken lines.

Figure 6:
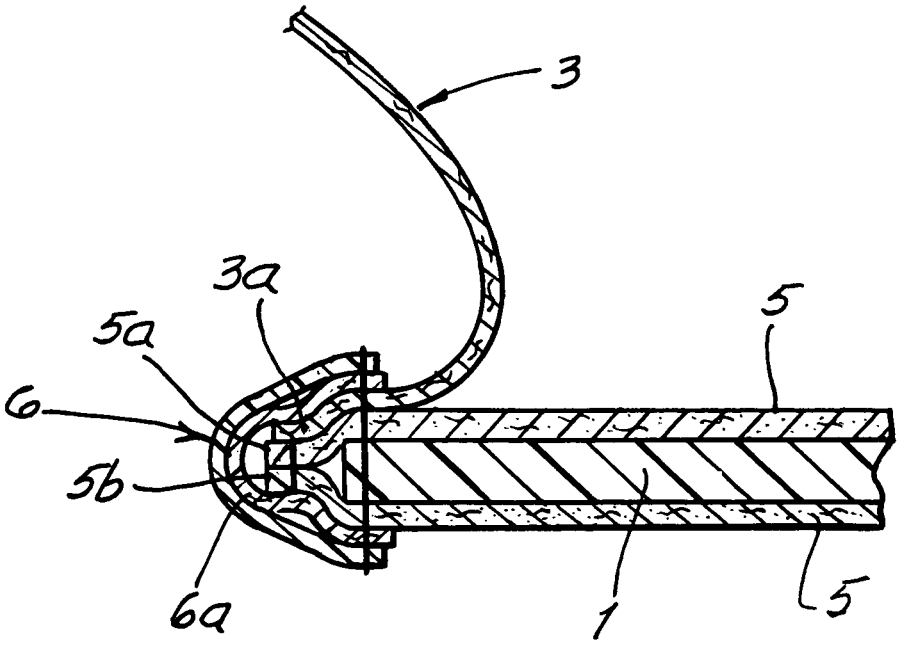
FIG. 6 is an enlarged section taken on lines 6-6 of FIG. 2.

Velcro Neoprene loop shaped arch support strap or straps 3 has lower end 3*a* connected and sewn to edge portions of the top and bottom Neoprene fin base coverings 5 as seen in FIGS. 2 and 6. The arch support strap 3 is pulled from the side across the top of the foot and threaded through a plastic rectangular loop 8 and pulled back across the foot top and exposed surface of 3, and fastened to that surface by a strip 9 of Velcro hooks 9*a*.

Figure 1:
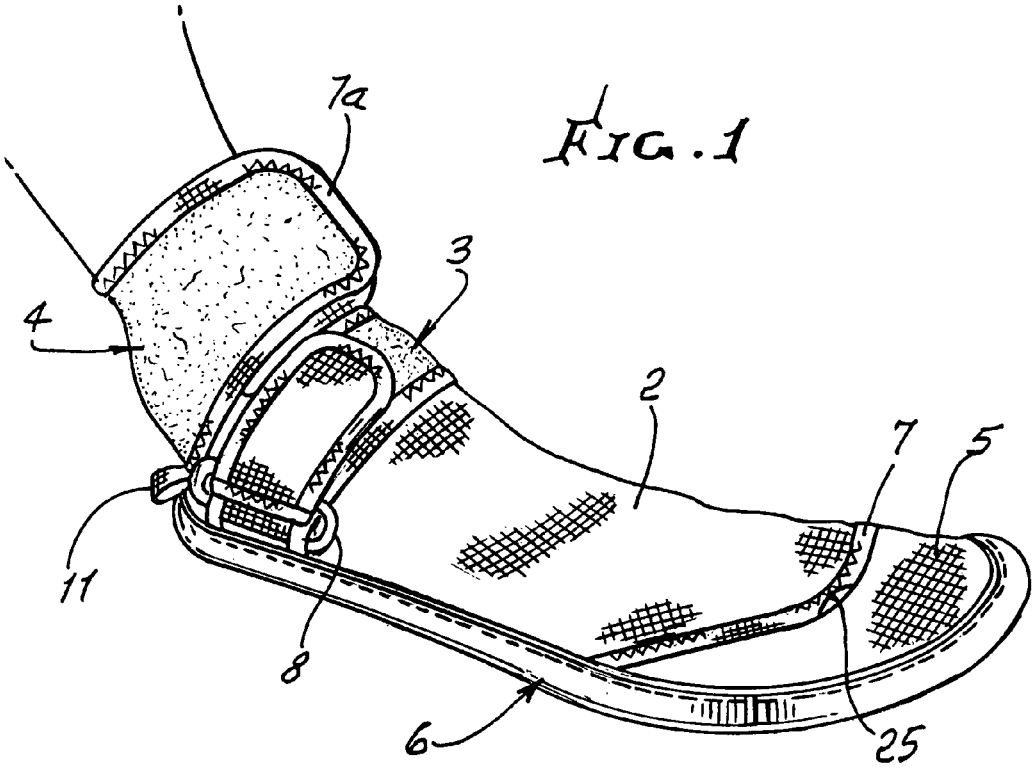
FIG. 1 is a perspective view of a swim fin embodying the invention.
Figure 3:
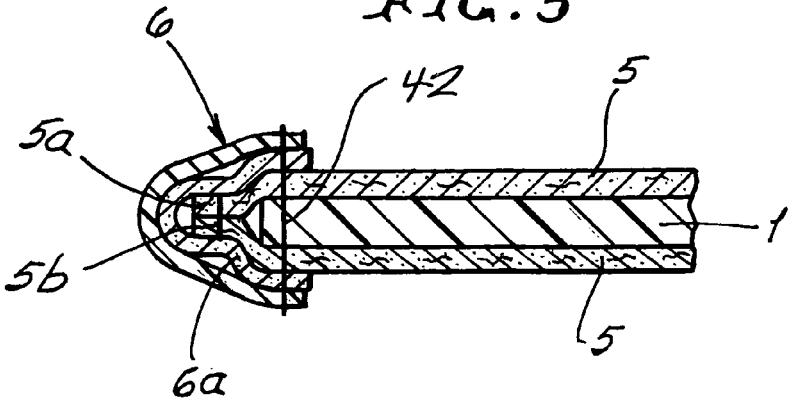
FIG. 3 is an enlarged section taken on lines 3-3 of FIG. 2.
Figure 5:
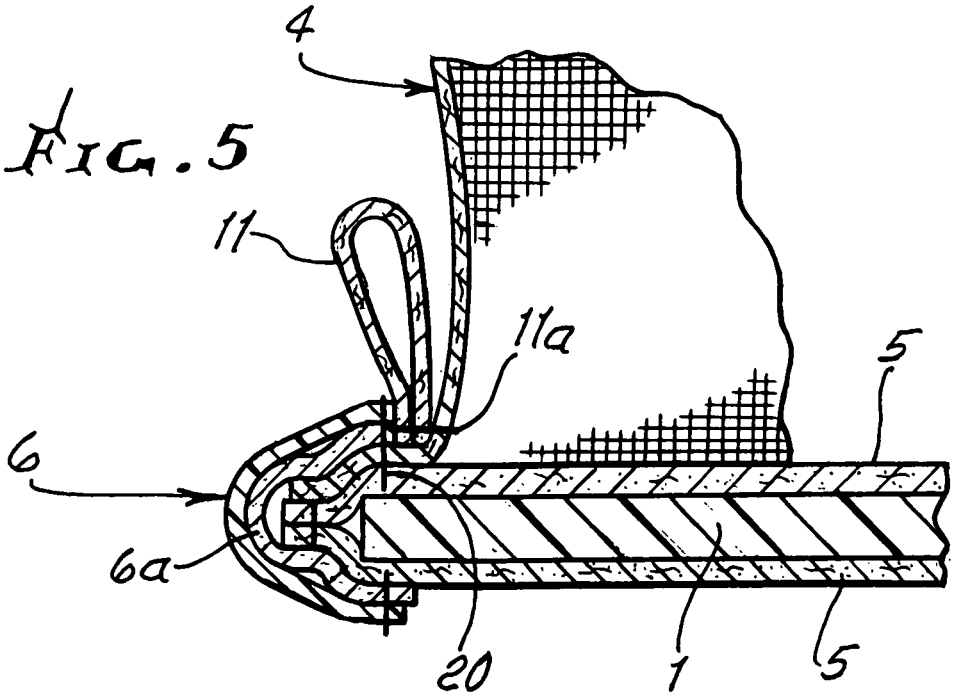
FIG. 5 is an enlarged section taken on lines 5-5 of FIG. 2.

The cup shaped ankle brace/heel support enclosure 4 is outlined with peripheral Lycra binding 7*a* and sewn at 20 onto 6 and 6*a*, as seen in FIG. 5, and preferably also onto the Neoprene fin base top/cover 5; a polypropylene pull tab loop 11 is sewn at 11*a* to the lower/rear of the ankle/heel support enclosure. Sewing of the Neoprene fin base top/bottom covers 5 together along with already sewn in place foot top 2; arch support strap 3; ankle brace/heel support enclosure 4; and polypropylene webbing securing plastic rectangular loop 8, provides an extremely secure, strong and lightweight integrated retention assembly, with a high degree of flexibility of components and comfort to the user's foot. See also further stitching 42 in FIG. 3, connecting 1, 5, 6*a* and 6.

The outward exposed synthetic elastomer binding 6 is bound through and to all layers (2, 3, 4, 5, and 6*a*) along the edge of the fin, and covers and protects the interconnections.

The invention provides a comfortable swimming experience for those who wear fins. The soft Neoprene arch support strap secures one's foot on the polypropylene fin base without causing blistering or chafing; this allows the swimmer to wear the fin for extended periods of time. The fin is lightweight and designed to give maximum propulsion in the water. The Neoprene enclosure is self-tensioning in such manner that the foot and toes are not compressed The Neoprene foot enclosure allows swimmers with foot or ankle distortion to have a perfect fit, and provides ultimate support to the ankle and heel, and makes it easy to put the fins on and take off. There is typically no left or right fin distinction; both fins are cut the same to avoid any uncertainty when putting them on. The polypropylene insert paddle gives optimum amount of limited flexibility to the fin for swimming in a pool, lake or the ocean.

Typical construction features are as follows:

1. Polypropylene fin insert—The polypropylene fin insert of the invention is constructed to create resistance in the water for greater speed and power through the water as you kick your feet. It is cut to extend approximately two or three inches past the toes of an average foot. The top area of the fin is cut in a fan like shape, approximately 7½ to 8½ inches wide, then contours to approximately 3½ to 4 inches across as it reaches the middle part of the foot, depending also on the size the user requires; continuing to contour down to approximately 3 to 3½ inches at the heel part of the foot once again depending on the size. The polypropylene fin insert is flat, with small bendability to provide least resistance and give the swimmer a true feel of muscle memory and strengthens the swimmers workout.
2. Foot Enclosure—The Neoprene foot enclosure is typically about 3.6 mm thick and is designed to completely enclose the foot and keep the foot secure on the polypropylene fin insert. The self-adjustable and flexible Neoprene foot enclosure is self-tensioning as the foot moves, to ensure maximum comfort without blistering or chaffing to the foot and toes. It also stretches, forms, and contours to accommodate to the size and shape of the wearer's foot, particularly the user with foot, toe and ankle distortion. The resiliently stretchable Neoprene foot enclosure encompasses the foot from the ankle to approximately one inch past the toes. At the top edge of the Neoprene foot enclosure is a ¾ inch drain hole 25. The finished edge of the Neoprene/polypropylene layer is bound together with a synthetic elastomer binding. The finished edges of the Neoprene foot enclosure comprise a Lycra binding.
3. Arch support strap—Velcro loop Neoprene about 2 mm thick is configured to keep the heel and ankle supported firmly on the polypropylene and Neoprene fin base. The ankle support strap is preferably one piece, made of Velcro loop Neoprene, which is sewn onto the side instep area, then crosses the top of its foot to the other side where it is looped through a 2 inch plastic rectangular retention loop and fastens firmly and securely on top of the foot with Velcro hook sewn in place at the edge for attachment (dims.—2 inch×4 inch).
4. Ankle brace/heel support enclosure—The ankle brace/heel support enclosure is one piece, made of 2 mm Neoprene loop. There is a small dart seamed in the center of the lower heel which keeps the heel in place. The wrap around ankle heel support is firmly secured in the anterior portion of the lower leg by over lapping the two ends, one of which has Velcro hook sewn in place at the edge (dims—4 inch×4 inch). Centered at the outer face of the ankle/heel support, there is a polypropylene pull tab (dims—½ inch×3 inch). Also, a dart is provided as at 41.
5. Neoprene fin base—2 mm thick Neoprene material are the top and bottom sections that covers a polypropylene fin insert. The Neoprene covering both sides of the polypropylene fin insert is exposed Neoprene (mesh skin) on the bottom, and Nylon on the top. The exposed Neoprene (mesh skin) is to ensure a tight fit on the polypropylene fin insert and prevents any bunching or slipping when in the water.
6. Synthetic elastomer binding—The synthetic elastomer binding is typically approximately 1¼ inch wide and is sewn through all layers of Neoprene and polypropylene and outlines the
7. Lycra binding—Used to allow stretching along the arch support strap and ankle brace heel support enclosure areas.
8. Plastic rectangular loop—2 inches wide.
9. Velcro hook and loop—Velcro hook pressure sensitive and a likeness of tiny hooks that when applied to the Velcro loop which is a pile based material will fasten together to cause a very strong binder.
10. 100% polypropylene webbing strapping (holds the plastic rectangular loop)—2 inches wide by 3 inches long.
11. 100% polypropylene webbing strapping (forms a pull tab 11 at the center base of heel support)—¼ inch wide by 3 inch long.

We claim:

1. A swim fin having, in combination, a) a blade including an inner thin board, and upper and lower Neoprene sheet or sheets covering upper and lower sides of the board, b) the upper Neoprene sheet defining a foot entrance, c) a forward foot retention strap or straps carried by the blade to extend proximate said entrance and over the foot, d) a rearward retainer carried by the blade to extend above the rearwardmost portion of the blade, e) said forward retention strap and said rearward retainer both being flexible, f) and primary seam binding extending at the periphery of said board, connecting the Neoprene sheet or sheets to the board and also anchoring the forward strap and the rearward retainer to the board, g) and wherein the primary seam binding extends lengthwise and has a C-shaped cross sections along its length normal to said length, h) and including connective stitching extending through upper and lower edge portions defined by both the primary and secondary seam bindings, the stitching extending through edge extent of said board.

2. The swim fin of claim 1 wherein the primary seam binding extends lengthwise and has C-shaped cross sections along its length normal to said length.

3. The swim fin of claim 1 including secondary seam binding interconnecting edges defined by said upper and lower Neoprene sheets.

4. A swim fin having, in combination, a) a blade including an inner thin board, and upper and lower Neoprene sheet or sheets covering upper and lower sides of the board, b) the upper Neoprene sheet defining a foot entrance, c) a forward foot retention strap or straps carried by the blade to extend proximate said entrance and over the foot, d) a rearward retainer carried by the blade to extend above the rearwardmost portion of the blade, e) said forward retention strap and said rearward retainer both being flexible, f) and primary seam binding extending at the periphery of said board, connecting the Neoprene sheet or sheets to the board and also anchoring the forward strap and the rearward retainer to the board, g) and including secondary seam binding interconnecting edges defined by said upper and lower Neoprene sheets, h) and wherein said secondary seam binding is located within the primary seam binding, there being connective stitching extending through upper and lower edge portions defined by both the primary and secondary seam bindings, the stitching extending through edge extent of said board.

5. The swim fin of claim 3 wherein the secondary seam binding extends lengthwise and has C-shaped cross sections along its length.

6. A swim fin having, in combination, a) a blade including an inner thin board, and upper and lower Neoprene sheet or sheets covering upper and lower sides of the board, b) the upper Neoprene sheet defining a foot entrance, c) a forward foot retention strap or straps carried by the blade to extend proximate said entrance and over the foot, d) a rearward retainer carried by the blade to extend above the rearwardmost portion of the blade, e) said forward retention strap and said rearward retainer both being flexible, f) and primary seam binding extending at the periphery of said board, connecting the Neoprene sheet or sheets to the board and also anchoring the forward strap and the rearward retainer to the board, g) the primary seam binding that extends lengthwise and has C-shaped cross sections along its length normal to said length, h) and including secondary seam binding interconnecting edges defined by said upper and lower Neoprene sheets, the secondary seam binding received within the primary second binding, and lengthwise thereof.

7. The swim fin of claim 4 wherein the rearward retainer has a lower extent retained to said board by said stitching.

8. Two swim fins as defined in claim 1, each having symmetrical construction to allow the fins to be worn by left or right foot without preference, making no distinction between either of the fins.

9. The swim fin of claim 1 characterized by self-tensioning as the foot moves to ensure maximum comfort with no blistering or chafing to the foot and toes.

10. The swim fin of claim 1 having a drain hole in the upper Neoprene sheet, proximate the toe area to ensure that water flows through the toe area so as to prevent drag as on the user's kick.

11. The swim fin of claim 1 including a small dart seamed in the center of the lower heel which keeps the heel in place.

12. The swim fin of claim 1 wherein the forward strap is firmly secured at the anterior of the lower leg and above the ankle by over lapping the two ends, one of which has Velcro hook material sewn in place at the edge.

13. The swim fin of claim 1 wherein the rearward retainer is tightened securely when it encases the ankle and lower leg to immobilize the ankle against inversion or eversion while permitting plantar-flexion and dorsa-flexion.

14. The swim fin of claim 1 wherein a) the material of the rearward retainer adapts to any size foot or ankle that has been distorted, due to injuries or surgeries that has caused a difference in the user's foot size from the left to right foot, b) the material of the rearward retainer provides and is configured to enhance ankle stability to user's with ankle injuries such as strains, brakes, fractures and ligament injuries and it also supports the ankle having weakness such as tendinitis, arthritis and osteoporosis, c) the material of the rearward retainer provides stability to the ankle to help prevent ankle joint twisting (anterior subluxation) that may generate unwanted force on the user's feet, ankles, knee's and hips.

15. A swim fin having, in combination, a) a blade including an inner thin board, and upper and lower Neoprene sheet or sheets covering upper and lower sides of the board, b) the upper Neoprene sheet defining a foot entrance, c) a forward foot retention strap or straps carried by the blade to extend proximate said entrance and over the foot, d) a rearward retainer carried by the blade to extend above the rearwardmost portion of the blade, e) said forward retention strap and said rearward retainer both being flexible, f) and primary seam binding extending at the periphery of said board, connecting the Neoprene sheet or sheets to the board and also anchoring the forward strap and the rearward retainer to the board, g) wherein the forward strap comprises material sewn onto the side instep area, drawn across the top of the foot and threaded into a plastic rectangle loop on the other side of the foot and pulled back and secured on the top of the foot.

16. A swim fin having, in combination, a) a blade including an inner thin board, and upper and lower Neoprene sheet or sheets covering upper and lower sides of the board, b) the upper Neoprene sheet defining a foot entrance, c) a forward foot retention strap or straps carried by the blade to extend proximate said entrance and over the foot, d) a rearward retainer carried by the blade to extend above the rearwardmost portion of the blade, e) said forward retention strap and said rearward retainer both being flexible, f) and primary seam binding extending at the periphery of said board, connecting the Neoprene sheet or sheets to the board and also anchoring the forward strap and the rearward retainer to the board, g) wherein the swim fin has an open position wherein the strap and rearward retainer have an open and substantially flattened configuration in which flexible and mutually attachable flaps defined by the rearward retainer extend in opposite lateral directions, and a shallow, warped cup-shaped heel entrance defined by the rearward retainer is positioned in semi-flattened condition between said flaps, the base and said flaps defining an overall T-shape, with flexibility of the straps, flaps and of the cover at the foot entrance allowing flexing thereof to ease accommodation and comfort of foot entrance to the apparatus and heel positioning, prior to strap and flap attachment.

* * * * *